United States Patent [19]

Edwards et al.

[11] 4,343,840

[45] Aug. 10, 1982

[54] METHOD AND APPARATUS FOR TREATING CELLULOSIC PRODUCTS

[75] Inventors: Ben E. Edwards, Blowing Rock; Clyde M. Marr, Greensboro, both of N.C.

[73] Assignee: Old-North Manufacturing Company, Inc., Lenoir, N.C.

[21] Appl. No.: 238,835

[22] Filed: Feb. 27, 1981

[51] Int. Cl.[3] ..... C23C 13/08; B05D 1/18; B05D 3/12

[52] U.S. Cl. ..... 427/351; 118/50; 118/50.1; 427/377; 427/378; 427/440; 427/441

[58] Field of Search ..... 427/350, 351, 377, 378, 427/439, 440, 441; 118/50, 50.1

[56] References Cited

U.S. PATENT DOCUMENTS

| | | | |
|---|---|---|---|
| 1,184,452 | 5/1916 | Hopewell . | |
| 1,499,791 | 7/1924 | Shipley . | |
| 1,513,928 | 11/1924 | Oenslager et al. . | |
| 1,713,388 | 5/1929 | Kobiolke . | |
| 1,756,797 | 4/1930 | Rawson . | |
| 1,811,107 | 6/1931 | Barnebey . | |
| 2,007,753 | 7/1935 | Ericson . | |
| 2,135,030 | 11/1938 | Boller . | |
| 2,303,257 | 11/1942 | Campbell et al. . | |
| 2,334,586 | 11/1943 | Shipley . | |
| 2,839,838 | 6/1958 | Munters . | |
| 2,901,425 | 8/1959 | Waddill . | |
| 3,959,529 | 5/1976 | Winn et al. | 427/351 X |
| 3,967,011 | 6/1976 | Dunn . | |
| 3,968,276 | 7/1976 | Allen | 427/297 |
| 4,062,991 | 12/1977 | Kyte et al. | 427/297 |
| 4,175,034 | 11/1979 | Thompson . | |
| 4,247,332 | 1/1981 | Kihoshita et al. | 427/351 X |

*Primary Examiner*—Michael R. Lusignan

*Attorney, Agent, or Firm*—Bell, Seltzer, Park & Gibson

[57] ABSTRACT

A method and apparatus for impregnating low density fiberboard with asphalt is disclosed, and which includes stacking the sheets, placing the stacks in a sealable chamber, and flooding the chamber with a treating solution composed of a mixture of asphalt and solvent. The chamber is thereafter drained, and the fiberboard is then heated by the injection of live steam into the chamber. A partial vacuum is then drawn in the chamber, while condensing and separating the withdrawn solvent and water vapors. Both the condensed solvent and water of the steam injection system are maintained in closed conduit systems to permit their reuse and to prevent contamination of the environment.

26 Claims, 7 Drawing Figures

METHOD AND APPARATUS FOR TREATING CELLULOSIC PRODUCTS

The present invention relates to a method and apparatus for treating a cellulosic fiberboard product or the like with preservative solution, and which is characterized by relatively low production costs, conservation of resources, and the substantial absence of the release of pollutants to the environment.

Various wood products are commonly impregnated with a preservative by a process wherein the products are immersed in an open tank containing a treating solution composed of the preservative and a hydrocarbon solvent. The products are thereafter removed from the solution, and dried or cured in the atmosphere for a period of several days to permit the solvent to evaporate. In the specific case of sheets of low density wood fiberboard to be used as expansion joint filler in concrete roadways or the like, the fiberboard is treated by immersion in a solution containing asphalt and a naphtha solvent, and the drying or curing in the atmosphere requires a minimum of about two weeks.

As will be apparent, the above process is not only time consuming, but it requires multiple handling of the product, and it results in the release of the vaporized solvent to the atmosphere. Such release is unacceptable for environmental reasons, and the loss of the solvent renders the process relatively expensive. Finally, the use of open tanks of the preservative solution presents a fire hazard.

It is accordingly an object of the present invention to provide a method and apparatus for treating a cellulosic product of the described type, and which effectively overcomes the above problems associated with the existing process.

It is a more particular object of the present invention to provide a method and apparatus for treating a cellulosic product such as fiberboard sheet material with a preservative solution, and which significantly reduces the overall processing time as compared to the above presently employed system, and which recovers substantially all of the solvent to thereby avoid harmful release of the solvent to the atmosphere and minimize the cost of the operation.

It is also an object of the present invention to provide a method and apparatus for treating a cellulosic product of the described type and which minimizes the product handling steps, and reduces the fire hazard as compared to the existing process.

These and other objects and advantages of the present invention are achieved in the embodiment illustrated herein by the provision of a method and apparatus which includes a closable fluid and air tight treatment chamber adapted to receive therein the product to be treated, a solution storage tank for receiving a treating solution which is composed of a preservative and solvent, means for selectively delivering the solution from the storage tank to the treatment chamber and for returning the unused or nonabsorbed solution back to the storage tank, means for selectively injecting live steam into the treatment chamber, means for withdrawing vapors from the chamber and including means for condensing and separating any solvent and water vapor removed by the withdrawing means to permit the separate reuse thereof.

In use, the product to be treated is initially placed in the treatment chamber, and the chamber is flooded with the treating solution which may be heated above ambient temperature. The non-absorbed solution is then pumped back to the solution storage tank, and live steam is then injected into the treatment chamber to heat the products therein. Upon the steam pressure reaching a predetermined level, the vapors are withdrawn from the treatment chamber preferably by use of a vacuum pump, while condensing and separating the solvent and water vapor from the withdrawn vapor. The separated condensed solvent is delivered to a solvent storage tank, and the separated water is delivered to a heat exchanger adapted to form steam therefrom.

Since the drawing of a partial vacuum within the treatment chamber acts to lower the temperature of the fiberboard below the temperature at which the solvent readily vaporizes, it is preferable to reheat the product by again injecting live steam into the treatment chamber when the temperature of the product reaches a point below the solvent vaporization temperature. By this arrangement, the temperature of the board is again increased, and a partial vacuum is then again drawn within the treatment chamber, while condensing and separating the solvent and water vapor in the manner described above. Periodically, the solvent is withdrawn from the solvent storage tank and mixed with the preservative to provide an additional quantity of the treating solution. Also, the steam generated by the heat exchanger is utilized as the source of the steam employed in each of the two heating steps. Thus, the solvent of the treating solution and the water of the steam employed in the heating steps associated with the treatment chamber are each confined in a closed system, and thus not released to the environment.

In the case of treating low density fiberboard material, it has long been recognized that subjecting such material to steam or water would rapidly swell the material and reduce its strength, and thus the use of steam in processing such fiberboard material has been avoided. In accordance with the present invention however, it has been found that the use of live steam not only effectively raises the temperature of the fiberboard to supply the heat of vaporization for the solvent and thereby provide for its more rapid vaporization, but surprisingly, the steam and resulting water does not harm the fiberboard since the added moisture is removed in the subsequent vacuuming operation. Also, such fiberboard is an effective insulator against any type of radiant of conductive heating, and live steam applied in accordance with the present invention has been found to circumvent its insulation properties and to rapidly and effectively heat the fiberboard by convection.

Some of the objects and advantages of the invention having been stated, others will appear as the description proceeds, when taken in connection with the acompanying drawings, in which FIG. 1 is a perspective view of the apparatus embodying the features of the present invention;

Figure 1:
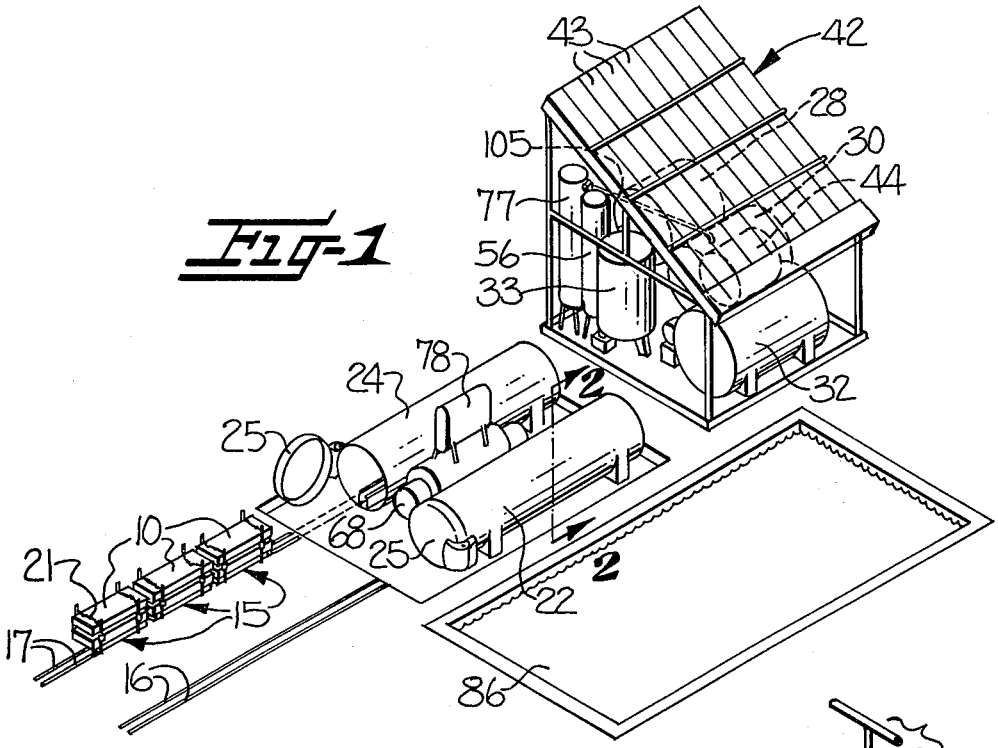
Figure 2:
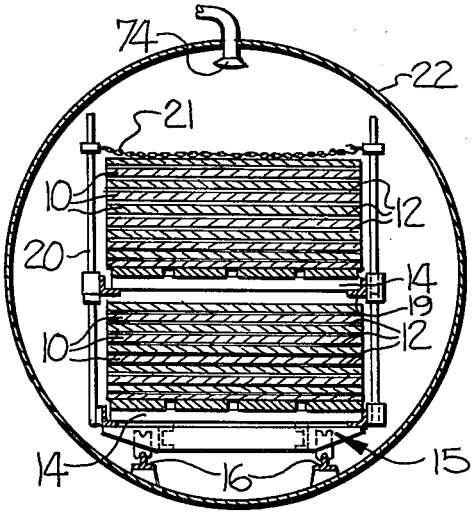
FIG. 2 is a sectional elevation view of a treatment chamber of the present invention, and taken substantially along the line 2—2 of FIG. 1.
Figure 3:
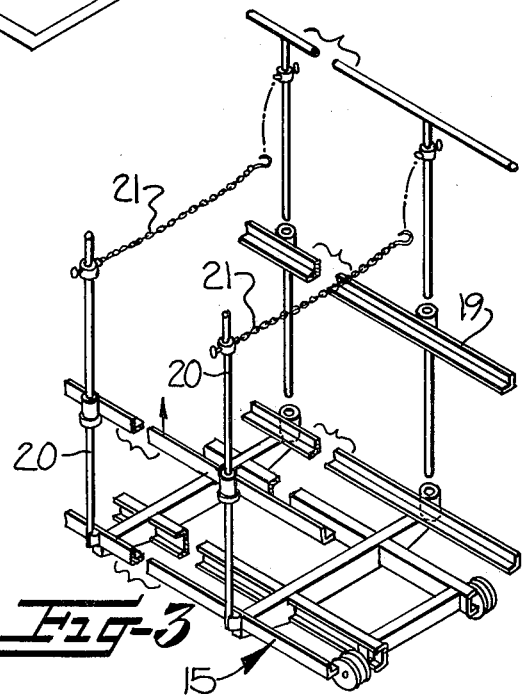
FIG. 3 is a fragmentary perspective view of a carriage adapted to support a plurality of sheets of fiberboard material in accordance with the specific illustrated embodiment of the present invention.
Figure 4:
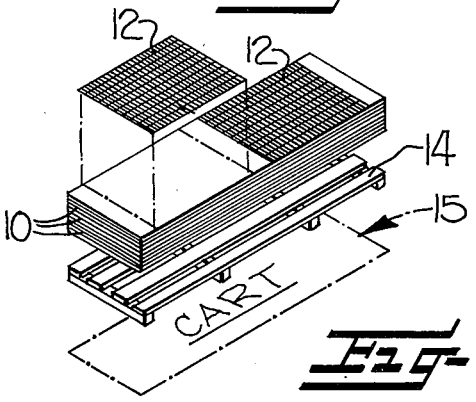
FIG. 4 is a schematic perspective view illustrating one embodiment of the means for separating the sheets of fiberboard while in a vertically stacked arrangement.
Figure 5:
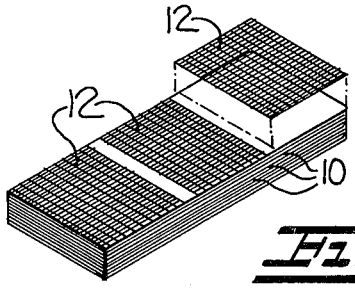
FIG. 5 is a perspective view similar to FIG. 4 and illustrating a second embodiment of the separating or spacing means.
Figure 6:
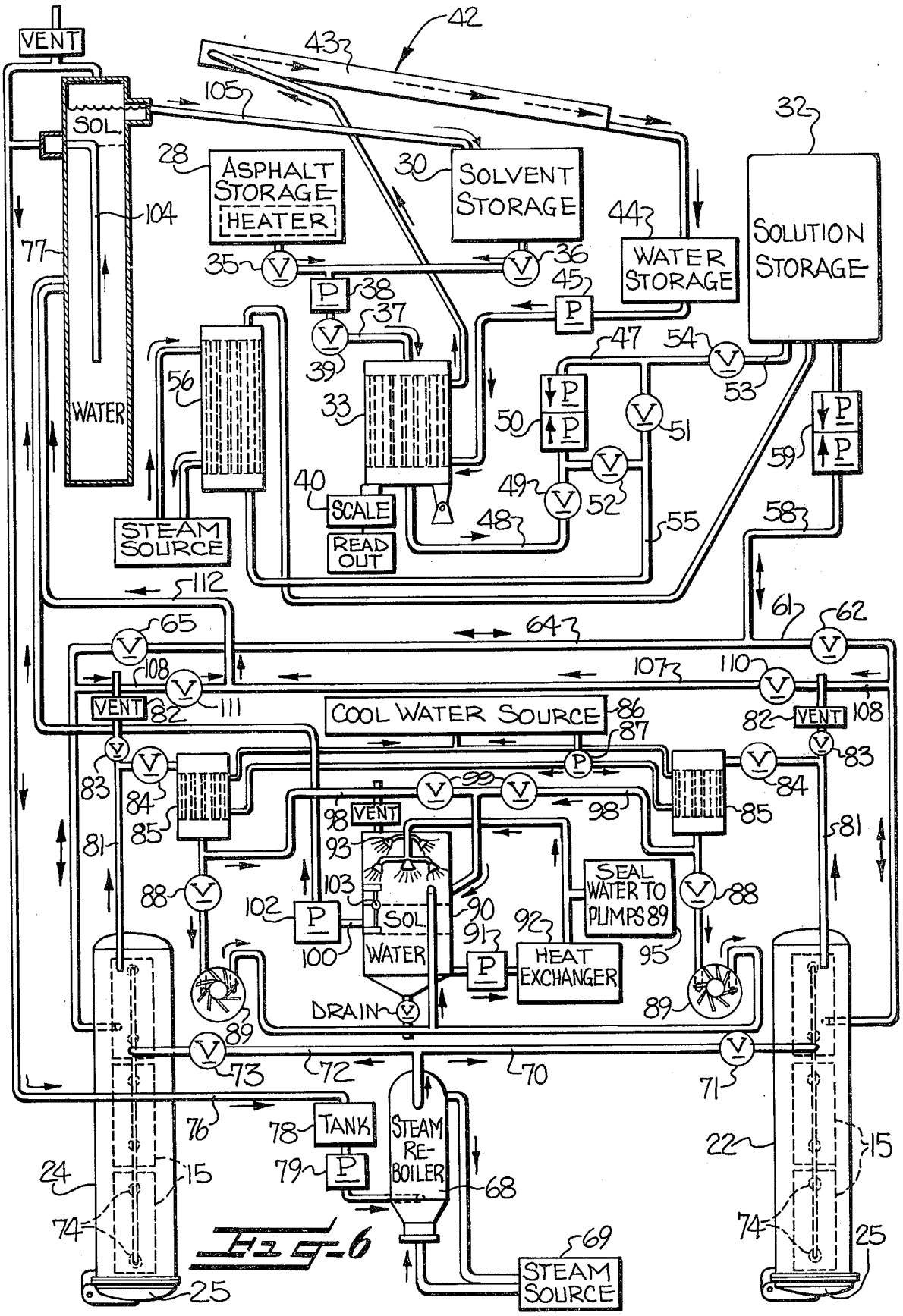
FIG. 6 is a detailed schematic view of the apparatus shown in FIG. 1.

Referring more specifically to the drawings, FIGS. 1–6 illustrates an apparatus embodying the features of the present invention, and which is particularly adapted to process stacked sheets 10 of low density cellulosic fiberboard material of the type utilized in expansion joints for concrete roadways and the like. Such sheets typically measure 3×10 feet, or 4×10 feet, and have a thickness from ⅜ to 1 inch and a density of about fifteen pounds per cubic foot. The sheets 10 are initially stacked, with a slightly spaced relationship being maintained between the sheets to facilitate the penetration of the treating solution and steam as described below. In the illustrated embodiment, such spacing is maintained by means of 2×4 galvanized wire fencing 12 or the like, note FIGS. 4 and 5.

The stacked sheets are initially placed on a wooden pallet 14, which is in turn placed on a carriage 15 mounted on one of the two trackways 16, 17. The carriages 15 preferably include a separate upper support structure 19 whereby two stacks may be loaded on each carriage, with the weight of the upper stack being supported by the vertical posts 20 of the carriage. Also, a chain 21 is disposed above the upper stack to prevent upward floating movement of the sheets during subsequent immersion.

The apparatus further comprises a pair of like treatment chambers 22, 24, an each trackway 16, 17 is disposed to enter a respective chamber, and such that the loaded carriages 15 may be wheeled directly into the associated chamber. The chambers 22, 24 in the illustrated embodiment have a diameter of about 6 feet, and a length of about 32 feet, which is sufficient to accommodate three of the illustrated carriages. A forward door 25 is provided for sealing each chamber, and by design, the door is able to provide both a fluid tight and tight seal when closed.

The apparatus further comprises a preservative (typically asphalt) storage tank 28 having an internal steam heater, a solvent storage tank 30, and a treating solution storage tank 32. A blending tank 33 is also provided for supplying a weighed quantity of each of the asphalt and solvent to the solution storage tank 32. More particularly, the outlet of each of the tanks 28 and 30 is provided with a valve 35, 36 respectively, and the two outlets lead to a common line 37 having a pump 38 and valve 39, which leads to the tank 33. The blend tank 33 is mounted on a loading scale 40 which provides a continuous readout of the weight of the fluid in the tank 33. By this arrangement, a weighed quantity of each of the asphalt and solvent may be pumped into the tank 33.

A solar energy heating system 42 is associated with the blend tank 33 to heat the solution therein, and which comprises a network of solar collectors 43, a heated water storage tank 44, and a conduit system including the pump 45 for directing the water from the storage tank 44 through the blend tank 33 and back to the inlet end of the solar collectors 43. To conserve heat energy, each of the asphalt storage tank 28, solution tank 32, and blending tank 33 includes a heat insulating coating or jacket.

Between the blend tank 33 and solution storage tank 32, there is provided an outlet conduit 48 which mounts a valve 49, a conduit loop 47 mounting a reversible pump 50 and pair of valves 51, 52, an an inlet conduit 53 mounting a valve 54. Further, a branch conduit 55 extends from the loop 47 through a steam supplied heat exchanger 56 and back to the storage tank 32. This arrangement permits the solution to be selectively pumped through the heat exchanger 56, either from the blend tank 33 or from the solution storage tank 32, to thereby maintain a desired temperature of the solution.

A solution delivery system is also provided for periodically pumping the solution from the solution storage tank 32 to each of the two treatment chambers 22, 24, and thereafter returning the solution to the tank 32. This delivery system includes the outlet conduit 58 having a reversible pump 59, and which leads to a right branch 61 leading through the valve 62 to the treatment chamber 22, and a left branch 64 leading through the valve 65 to the treatment chamber 24.

Means are also provided for selectively injecting live steam into each of the treatment chambers 22, 24. This steam injecting means includes a steam reboiler 68 which is heated by a separate external steam source 69, a first branch line 70 leading through a valve 71 to the chamber 22, and a second branch line 72 leading through a valve 73 to the chamber 24. Each chamber 22, 24 includes a plurality of nozzles 74 extending along the top wall for injecting the steam along the full length of the chamber when the associated valve is opened. The water for supplying this steam is received by the reboiler 68 through the line 76, which leads from a solvent-water separation tank 77 as hereinafter further described, with the line 76 including a storage tank 78 and pump 79 adjacent the reboiler.

The apparatus of the present invention further comprises means for selectively drawing a partial vacuum in each of the treatment chambers 22, 24 and means for condensing and separating any solvent and water vapor removed by the vacuum drawing means, to permit the separate reuse thereof. More particularly, each of the two chambers includes an outlet conduit 81, which includes a vent 82 and valve 83, and then leads through a valve 84 to a condenser 85. The condenser 85 is cooled by water from a separate cool water source 86, such as the outdoor pool illustrated in FIG. 1, with the cool water being pumped through the condenser by the pump 87. The outlet from the condenser 85 leads through a valve 88 and vacuum pump 89 to a direct contact condenser or water spray tank 90. The condensed portion of the water and solvent vapors received in the spray tank 90 separate into layers by reason of their different densities, and a circulation system including the pump 91, cooling heat exchanger 92, and spray nozzles 93 maintain a continuous water spray from the top of the tank. The vacuum pumps 89 typically comprise a conventional liquid ring vacuum pump, which requires a supply of sealing water. In the illustrated embodiment, this sealing water in supplied by the water circulation system of the water spray tank 90, and as illustrated schematically at 95 in FIG. 6.

A branch line 98 extends from the outlet of each condenser 85 through an associated valve 99, and directly to the water spray tank 90. This arrangement provides a bypass circuit loop to permit the steam pressure to be reduced in the associated chamber to atmospheric pressure, and without going through the vacuum pump.

The water spray tank 90 includes an outlet 100 positioned to communicate with the separated solvent layer, and a pump 102 which is operatively controlled by the float switch 103 in the tank. The outlet 100 extends to the solvent-water separator tank 77, which permits the condensed water and solvent to gain separate into layers by reason of their different densities. The separator 77 includes an outlet 104 adapted to open in the separated water layer and which communicates with the line 76 leading to the steam boiler, and a second upper outlet 105 serves to drain the separated solvent back into the solvent storage tank 30. The apparatus further comprises a pair of condensate return lines 107, 108 extending from respective treatment chambers 22, 24, with each line including an associated valve 110, 111. The lines 107, 108 then join in a common line 112 which extends directly to the separator tank 77 for the purposes described below.

In describing the operation of the apparatus, it will be understood that the desired treatment solution will be initially made up and stored in the insulated tank 32 in the manner described above. The solution is heated by either the solar energy system 42, the heat exchanger 56, or both, and so as to preferably maintain a temperature of between about 150–160 degrees F. Thus as will be seen, the insulated tank 32 not only serves to store the solution for delivery to the fiberboard sheets, but it also serves as a heat storage means for transferring heat energy to the sheets to raise the temperature thereof and thereby facilitate the subsequent vaporization of the solvent.

When the treatment chamber 22 is loaded with the carriages 15, the door 25 is closed and the treatment solution is pumped into the chamber to flood the chamber and fully immerse and heat the stacks of fiberboard sheets 10. Immediately upon filling the chamber, the pump 59 is reversed, to return the solution to the tank 32. Thereafter, steam is injected into the treatment chamber from the reboiler 68, until a pressure of about 15 psig is reached and the fiberboard reaches a temperature of about 220 degrees F., which is well above the practical temperature limit of the solution in the tank 32. After reaching this pressure, the condensate return line 107, 112 is opened to blow out any condensed steam and solvent directly to the solvent-water separator tank 77, which results in a reduction to nearly atmospheric pressure in the chamber. The condensate line is then closed and the vacuum pump 89 is actuated, with the valves 84 and 88 being opened, whereby the vapors in the treatment chamber are withdrawn. The pump is operated until the pressure reaches about 27 to 28 inches of mercury, under typical operating conditions. The vapors pass through the condenser 85, where they are cooled and partially condensed, and then through the vacuum pump 89 which serves to compress and further condense the vapors. Finally, the uncondensed vapors along with the condensate from the condenser and vacuum pump are delivered directly to the water spray tank 90. In this regard, it will be noted that the water separated in the spray tank 90 is supplied to the spray nozzles 93 and to the vacuum pumps 89, and is thus maintained in a closed loop. Also, the separated solvent will be periodically pumped from the spray tank 90 to the separator tank 77 through the conduit 100, and when the pump 102 is actuated by the float switch 103.

The application of the vacuum to the fiberboard in the treatment chamber in the illustrated embodiment acts to cool the board to a temperature of about 110–120 degrees F. Below these temperatures, the board will become too cold to rapidly vaporize the solvent, and very little solvent is thereafter removed. Depending upon the size of the vacuum pump 89 and other components of the apparatus, this temperature is normally reached after about four to six hours of operation. At this point, the vacuum pump 89 is shut-off, and the fiberboard is reheated by injecting live steam into the treatment chamber for a second time from the reboiler 68. The chamber is again charged to about 15 psig, and the temperature of the board rises to about 240 degrees F., which provides sufficient heat for vaporization of the solvent during the subsequent or second vacuum step as described below. Depending upon the size of the reboiler, about one hour is required to reach the above pressure and temperature.

When the desired temperature and pressure is reached, the condensate return line 107, 112 is again opened to blow out any condensate, and the vacuum pump 89 is then again actuated to draw a vacuum within the treatment chamber. After about eight to ten hours of operation, a pressure of about 27 to 28 inches of mercury, and a temperature of between about 80–100 degrees F. are reached. The chamber 22 is then ready to open to permit removal of the carriages. In this regard, it will be understood that while two steam heating-evacuation cycles have been described herein, the number of such cycles may vary depending upon the desired range of operating temperatures for the fiberboard, and the nature of the solvent being removed.

In accordance with the specific embodiment of the invention as illustrated herein, it is preferred to utilize and operate the vacuum pumps 89 until a substantially subatmospheric pressure is reached in the treatment chamber as described above. It will be understood however that vapor transfer will take place between the treatment chamber and condenser 85 as long as there is any temperature and pressure differential therebetween. Thus transfer would also occur at either higher or lower temperatures and pressures so long as the differential were maintained, and the particular values set forth herein represent convenient levels only, rather than specific limitations of the invention.

Typically, the overall operation as described above requires about twenty four hours, and in the emodiment of FIGS. 1–6, the two treatment chambers 22, 24 are operated about one hour out of phase, so that the various pumping operations may be conducted without interference. The fiberboard, which initially has a density of about 15 pounds per cubic foot, typically has an asphalt pick-up of about 10 pounds per cubic foot.

Figure 7:
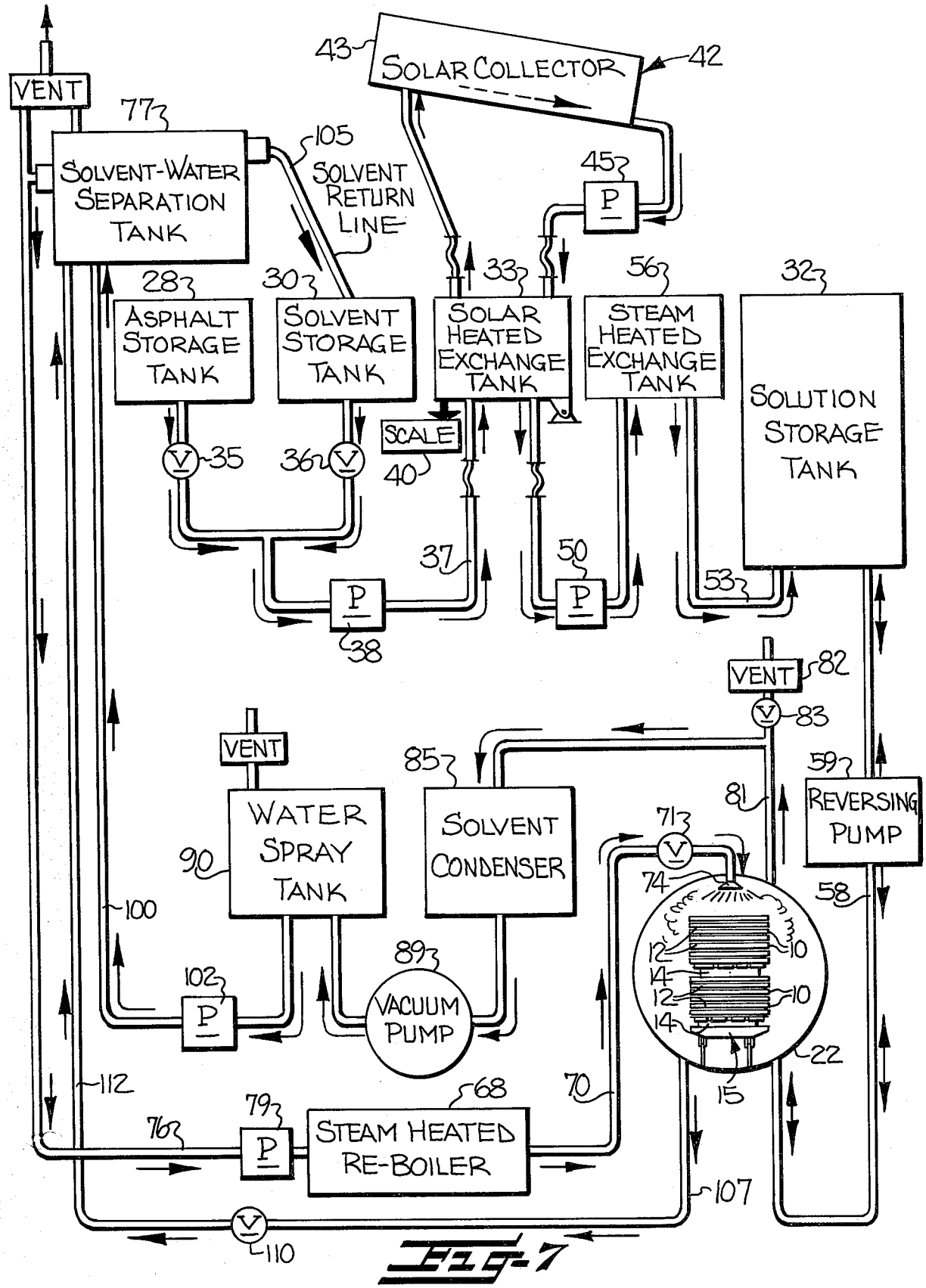
FIG. 7 is a somewhat simplified schematic view of a second embodiment of the present invention, and which includes only a single treatment chamber.

FIG. 7 illustrates a somewhat simplified embodiment of the present invention, and which includes a single treatment chamber 22. Common numerals have been used in FIG. 7 to indicate components which are common to those of the embodiment of FIGS. 1–6.

From the above description, it will be apparent that the method an apparatus of the present invention maintains the solvent in a closed loop, and except for trace amounts remaining in the fiberboard, very little if any of the solvent is lost. Further, the water of the steam supply for the reboiler 68 is also maintained in a closed loop, which prevents its release to the environment. Still further, both the initial heating step and the subsequent reheating step by the steam injection process acts to facilitate solvent vaporization and thus the speed of the process by raising the temperature of the board, and any deleterious absorption of water by the fiberboard is reversed by reason of the subsequent vacuuming operation which acts to dry the fiberboard.

In the drawings and specification, there have been set forth preferred embodiments of the invention and although specific terms are employed, they are used in a generic and descriptive sense only and not for purposes of limitation.

That which is claimed is:

1. A method of treating sheets of relatively low density cellulosic fiberboard material with a preservative solution, or the like, and characterized by relatively low production costs, conservation of resources, and the substantial absence of the release of pollutants to the environment, and comprising the sequential steps of placing the sheets to be treated in a treatment chamber, flooding the treatment chamber with a treating solution comprising a preservative and solvent and so as to fully immerse the sheets, removing the solution from the treatment chamber, heating the treated sheets by injecting live steam into the treatment chamber, and then drawing a partial vacuum within the treatment chamber and including withdrawing vapors therefrom, while condensing and separating any solvent and water vapor in the withdrawn vapors, to permit the separate reuse thereof, and then removing the treated sheets from the treatment chamber.

2. The method as defined in claim 1 comprising the further initial step of placing the sheets in a stack with spacing means between adjacent sheets, and conducting all of the recited steps while the sheets are maintained in such stack.

3. The method as defined in claim 2 comprising the further step of delivering the condensed solvent to a solvent storage tank, and periodically withdrawing the solvent from the solvent recovery tank and mixing the same with the preservative to provide an additional quantity of the treating solution, and while maintaining the solvent in a closed system during all of the recited steps.

4. The method as defined in any one of claims 1–3 comprising the further step of delivering the condensed water to a heat exchanger adapted to form steam therefrom, and utilizing the thus formed steam in the heating step, and while maintaining the water of the steam employed in the heating step in a closed system during all of the recited steps.

5. The method as defined in claim 4 wherein the treating solution is heated prior to flooding the treatment chamber and so as to heat the sheets upon being immersed therein.

6. A method of treating a cellulosic product with a preservative solution, or the like, and characterized by relatively low production costs, conservation of resources, and the substantial absence of the release of pollutants to the environment, and comprising the sequential steps of placing the product to be treated in a closable treatment chamber, flooding the treatment chamber with a treating solution comprising a preservative and solvent and so as to fully immerse the product, removing the solution from the treatment chamber, heating the product by injecting live steam into the treatment chamber, drawing a partial vacuum within the treatment chamber, while condensing and separating any solvent and water vapor from the withdrawn vapors, and while delivering the separated condensed solvent to a solvent storage tank and delivering the separated water to a heat exchanger adapted to form steam therefrom, reheating the product by injecting live steam into the treatment chamber, again drawing a partial vacuum within the treatment chamber, while condensing and separating any solvent and water vapor from the withdrawn vapors, and while delivering the separated condensed solvent to said solvent recovery tank and delivering the separated water to said heat exchanger, removing the treated product from the treatment chamber, periodically withdrawing solvent from said solvent storage tank and mixing the same with the preservative to provide an additional quantity of the treating solution, and utilizing the steam generated by said heat exchanger as the source of the steam employed in each of said heating and reheating steps, whereby the solvent of the treating solution and the water of the steam employed in said heating and reheating steps are each confined in a closed system.

7. The method as defined in claim 6 comprising the further step of initially heating the treatment solution to a temperature of between about 150–160 degrees F.

8. The method as defined in either of claim 6 or 7 wherein the treated product comprises a plurality of sheets of relatively low density fiberboard material, and wherein the method comprises the further step of forming a stack of the fiberboard sheets while maintaining a spaced relationship between the sheets, and maintaining this stacked configuration during the treating steps to facilitate the penetration of the treating solution thereinto.

9. The method as defined in claim 6 wherein each of the heating and reheating steps includes injecting steam to result in a pressure of at least about 15 psig, and such that the fiberboard reaches a temperature of between about 220–240 degrees F.

10. The method as defined in claim 9 wherein each of the vacuum drawing steps results in a substantially subatmospheric pressure in the treatment chamber, and such that the fiberboard is cooled to between about 110–120 degrees F.

11. The method as defined in claim 10 wherein the step of periodically withdrawing the solvent includes the steps of adding weighed quantities of the solvent and liquid preservative in a blending tank, and periodically conveying the resulting mixture from the blending tank to a treating solution storage tank.

12. A method of treating a cellulosic product with a preservative solution, or the like, and characterized by relatively low production costs, conservation of resources, and the substantial absence of the release of pollutants to the environment, and comprising the sequential steps of placing the product to be treated in a closable treatment chamber, flooding the treatment chamber with a heated treating solution comprising a preservative and solvent and so as to fully immerse the product while heating the same, removing the solution from the treatment chamber, injecting live steam into the treatment chamber to further heat the product, drawing a partial vacuum within the treatment chamber, while condensing and separating any solvent and water vapor from the withdrawn vapors to permit the separate reuse thereof, again injecting live steam into the treatment chamber to reheat the product, again drawing a partial vacuum within the treatment chamber, while condensing and separating any solvent and water vapor from the withdrawn vapors to permit the separate reuse thereof, and removing the treated product from the treatment chamber.

13. The method as defined in claim 12 wherein the cellulosic product comprises sheets of relatively low density fiberboard material, and comprising the further initial step of placing the sheets in a stack with spacing means between adjacent sheets, and conducting all of the recited steps while the sheets are maintained in such stack.

14. An apparatus adapted for impregnating a cellulosic product with a treating solution, or the like, and characterized by relatively low production costs, conservation of resources, and the substantial absence of the release of pollutants to the environment during the use thereof, and comprising a closable fluid and air tight treatment chamber adapted to receive therein a quantity of the product to be treated, a solution storage tank adapted to receive a treating solution which includes a relatively volatile solvent, means for selectively delivering the solution from said storage tank to said treatment chamber to substantially fill the chamber, and for returning the solution from the treatment chamber to the tank, means for selectively injecting live steam into the treatment chamber, a vapor removal line operatively connected to the treatment chamber, means for selectively creating a partial vacuum in said vapor removal line to draw solvent and water vapor into said line, and including means for condensing and separating any solvent and water vapor drawn into line to permit the separate reuse thereof, and means for returning the solvent separated by said condensing and separating means to said solution storage tank, to thereby confine the solvent in a closed system.

15. The apparatus as defined in claim 14 further comprising means for heating the water separated by said condensing and separating means, and utilizing such heated water as the source of the steam for said steam injection means, and whereby the water of said steam injection means is confined in a closed system.

16. The apparatus as defined in either of claim 14 or 15 wherein said means for returning the separated solvent to said solution storage tank includes a solvent storage tank, means for returning the solvent separated by said condensing and separating means to said solvent storage tank, and means operatively interconnecting said solvent storage tank and said solution storage tank to permit solvent to be periodically delivered from the former to the latter tank.

17. The apparatus as defined in claim 16 wherein said means interconnecting said solvent storage tank and said solution storage tank includes means for weighing the solvent to permit a predetermined quantity thereof to be delivered to said solution storage tank.

18. The apparatus as defined in claim 17 wherein the treating solution includes a preservative, and wherein said apparatus further comprises a preservative storage tank, and means operatively interconnecting said preservative storage tank and said solution storage tank to permit a weighed quantity of the preservative to be periodically delivered to said solvent storage tank.

19. The apparatus as defined in claim 16 wherein said solution storage tank is heat insulated, and further comprising means for heating the solution in said solution storage tank, and such that the solution delivered to said treatment chamber may be heated.

20. The apparatus as defined in claim 19 wherein said heating means includes solar energy absorptive means.

21. The apparatus as defined in claim 19 wherein said heating means includes a steam supplied heat exchanger.

22. The apparatus as defined in claim 16 wherein said means for condensing and separating the solvent and water vapor comprises condenser means for condensing the solvent and water vapor, and separator tank means positioned downstream of said condenser means for permitting the condensed water and solvent to separate into layers by reason of their different densities.

23. The apparatus as defined in claim 22 wherein said means for condensing and separating the solvent and water vapor further comprises water spray tank means positioned downstream of said condenser means and upstream of said separator tank means.

24. The apparatus as defined in claim 23 further comprising bypass conduit means for selectively venting the treatment chamber through said condenser means and directly into said water spray tank, to permit the treatment chamber to rapidly reach atmospheric pressure.

25. The apparatus as defined in claim 22 wherein said means for selectively creating a pressure differential further includes a vacuum pump mounted downstream of said condenser means.

26. The apparatus as defined in claim 22 further comprising means for selectively returning any condensate in said treatment chamber directly to said separator tank means.

* * * * *